United States Patent [19]

Didion

[11] 3,998,262

[45] Dec. 21, 1976

[54] CASTING SHAKE-OUT UNIT AND METHOD OF OPERATION

[76] Inventor: Charles J. Didion, 1213 Cherbrook, St. Charles, Mo. 63301

[22] Filed: Jan. 6, 1975

[21] Appl. No.: 538,959

[52] U.S. Cl. ..... 164/131; 164/404; 51/164; 209/297

[51] Int. Cl.[2] ..... B22D 29/00

[58] Field of Search ..... 164/131, 401, 404; 51/164; 209/288, 297, 372

[56] References Cited

UNITED STATES PATENTS

| | | | |
|---|---|---|---|
| 677,691 | 7/1901 | Packer | 51/164 |
| 1,743,833 | 1/1930 | Stall | 209/297 UX |
| 2,351,453 | 6/1944 | Perl | 51/164 X |
| 2,523,258 | 9/1950 | Ransohoff | 51/164 |
| 3,388,478 | 6/1968 | Vissers | 164/404 X |

FOREIGN PATENTS OR APPLICATIONS

| | | | |
|---|---|---|---|
| 1,220,976 | 7/1966 | Germany | 164/401 |
| 807,711 | 1/1959 | United Kingdom | 51/164 |

*Primary Examiner*—Ronald J. Shore
*Attorney, Agent, or Firm*—Paul M. Denk

[57] ABSTRACT

In a casting shake-out unit comprising a longitudinal cylinder being approximately horizontally disposed is driven in rotation by means of a motor, the cylinder includes a concentric inner cylinder formed as an apertured surface having rifling arranged helically upon its interior surface, with integral vanes helically arranged intermediate the inner apertured cylinder and the outer longitudinal cylinder. As sand encrusted castings are deposited into the cylinders, and while they are rotated, said castings are tumbled and urged to move longitudinally of the apertured cylinder while the loosened mold sand falls therethrough, and is likewise moved longitudinally of the apertured cylinder while the loosened mold sand falls therethrough, and is likewise moved longitudinally of the outer cylinder to a location for collection. The inner apertured cylinder or surface may be sectionalized, formed as modular components, for replacement as they wear out, and may be secured together and locked in place for forming a unitized inner apertured cylinder that functions as defined.

27 Claims, 9 Drawing Figures

CASTING SHAKE-OUT UNIT AND METHOD OF OPERATION

BACKGROUND OF THE INVENTION

This invention relates generally to a tumbling mill for new castings, but more particularly, pertains to a series of concentric cylinders that simultaneously move both the castings and its loosened mold sand for eventual disposition.

A great variety of various styles of tumbling devices or mechanisms are available in the prior art and primarily for usage for drying components, deburring machined parts, degreasing components, and even, more specifically, for removing sand from castings. In the latter use, such devices are generally identified as tumbling mills, and generally incorporate structure for providing roughened movement to castings for jarring loose any encrusted sand adhering from the mold. Most of these various style of prior art tumbling mills usually provide some form of an incline to a cylindrical shell, such as shown in the U.S. Pat. No. 2,955,305, issued to Jooss, and usually include some form of tumbling bars along the inner surface of a shell and function to set the sprues for cleaning. In this style of mill, the encrusted sand, as it is loosened, generally remains intermixed with the castings, and only in particular locations is the sand allowed to pass through some form of perforations for collection. In such a mill, its structure delineates the collection point at specific locations, which necessitates the intermixing of the loosened sand with the castings until said collection point(s) is reached.

In addition to the foregoing identified patent, many of the prior art devices are designed for treating much rather delicate castings or workpieces, and hence, are of a more sensitive design and not disposed for handling the removal of encrusted sand from larger and more heavier castings. In the patent to Bintzler, U.S. Pat. No. 2,933,861, one such continuous feed tumbling apparatus is shown, wherein the metallic workpieces enter the tumbling barrel by means of a charging chute, are moved longitudinally of the barrel by means of helical conveyor vanes, while an inner chamber being conical in shape is designed for moving and returning the treated material such as sawdust or other lightweight materials back to the entrance of the tumbling barrel to achieve and cause an intermixing, rather than separation of the cleaning materials with the workpieces or castings. This prior art patent is the only one known to provide for a returning of some form of treating material back to the entrance of a tumbling barrel, but structurally, and operationally, the disclosed prior art device is quite distinctly different from the construction and principle of operation of the present invention as to be hereinafter described and defined in greater detail.

In view of the foregoing, it is the principal object of this present invention to provide a shake-out mill that functions as a tumbling unit to instantly separate loosened mold sand from its castings, and then induce simultaneous movement either in the same or opposite directions of these segregated components to collection points.

It is another object of the present invention to dispose a pair of closely arranged concentric cylinders, the inner one being formed having an apertured surface, so that castings may be simultaneously tumbled while the encrusted mold sand is both loosened and separated immediately from the same.

A further object of this invention is to provide a casting shake-out unit that can function even when disposed horizontally.

An additional object of the present invention is to provide a tumbling shake-out unit that can be structurally arranged to provide for collection for the new castings and the loosened mold sand separately either both at the same or opposite ends of the apparatus' cylinder.

A further useful function of the present invention is to provide an apertured cylindrical surface within a shake-out unit that is sectionalized and formed from modular components that may be removed and replaced as they wear out as due to extended usage.

It is an additional object of the present invention to provide an integral casting shake-out unit that is substantially capable of being manufactured as an item of manufacture, and shipped as a single piece of equipment to the remote location of usage.

Another object of the present invention is to provide a casting shake-out that is comprehensive in its function, and can be operated by a minimum of labor all without supervision thereby reducing the heretofore substantial expenditure required in cleaning new castings.

These and other objects will become more apparent to those skilled in the art upon reviewing the summary of this invention, and the description of its preferred embodiment in view of its drawings.

SUMMARY OF THE INVENTION

This invention provides a structural means for providing multi-directional flow to various materials and components generally associated with the art of metal casting. While the structure of this invention may be utilized as a means for providing both separation and directional flow to any variety of product catagories, it preferably finds its utility as an instrumentation for separating fresh castings from their encrusted mold sand, and then furnishing the means for conveying these two components separably to different collection points as desired.

Structurally, the invention includes a length of cylinder that is employed as a tumbling barrel to furnish sufficient but minor impact to the conveyed castings for loosening the sand from its adherence, but which tumbling is not to any degree or extent that can cause any surface damage to the treated castings. Immediate separation of a casting from its mold sand is achieved through the use of a concentrically arrange inner cylinder, that is apertured or perforated, having sufficiently sized openings to allow the sand or other granular matter to fall therethrough, without allowing passage of any part of the casted components.

The rotation of these two concentric cylinders may be any where in the vicinity of six revolutions per minute, although obviously other speeds may be better adaptable to achieve enhanced results in the post treating of molded castings.

In the preferred embodiment, the outer of the concentric cylinders is imperforate except at its ends, having a completely closed cylindrical like shell, and has a length in the vicinity of 19 to 20 feet, while its outside diameter may be within the vicinity of 48 to 54 inches. The inside diameter of the concentric inner sheel is in the vicinity of 40 to 48 inches, and due to the thickness of the two cylinders there remains preferably a spacing in the vicinity of 4 inches more or less intermediate these two cylinders and which functions in achieving the principle of operation of this invention. Obviously, other dimensions may be built into this casting shake-out unit to provide its performance in attaining the desired similar results from use of this invention.

As previously analyzed, the principle object of this invention is to provide separation of the castings from its encrusted mold sand, and then either in the same or opposite directional flow cause these two separated components to be delivered to collection points. To achieve this, the inner apertured concentric cylinder is designed to allow the passage of any loosened sand therethrough, while in no manner may any of the castings or its components be diverted through the same.

Structure means in the form of rifling or shallow ribs are provided spacedly upon the inner surface of the apertured inner cylinder and helically disposed for urging the castings to move longitudinally of the rotating cylinders. Likewise, structural means in the form of vanes disposed intermediate the spacing provided between the inner apertured cylinder and the outer cylinder are also helically arranged so that any sand that has fallen through the inner cylinder to the inner surface of the outer cylinder will be urged and moved by the vanes due to the rotation of the concentric cylinders. The directional flow of the separated castings and sand may be in the same direction, or in opposite directions, depending upon the relationship and disposition of the rifling and the intermediate vanes. For example, if both said members are arranged in the same helical direction, the both the casting and the sand will be urged in the same longitudinal directional along their respective separate cylinder surfaces. On the other hand, if the vanes are arranged helically opposite from the rifling, then the castings will be urged in an opposite direction from the movement of the sand during rotation of the shake-out unit.

Where the aforesaid structural disposition of the combined rifling and vanes are helically angulated in the same direction so that the castings and sand are moved simultaneously longitudinally in the same direction, then it might be preferable to structurally extend the inner apertured cylinder slightly beyond the outer cylinder so that the casting and sand will not drop at the same precise location from the end of the shake-out unit, but rather, the sand may drop from the end of the outer cylinder, while the castings will be moved a slight distance further by means of the rifling arranged upon the surface of the inner cylinder to there fall from this extended end of said inner cylinder and spacedly from the position of drop of the aforesaid loosened sand. Then, both separated components may be either collected or conveyed by other conveyor means to different remote locations. In addition, rather than extend the inner cylinder beyond the outer cylinder, as aforesaid, it may be just as likely that the outer cylinder for a fixed dimension proximate its end, may also be apertured, so that the moving sand may fall therethrough for collection, while the castings are continued in their longitudinal shifting along the concentric inner cylinder for their eventual drop from the end of the same.

DESCRIPTION OF THE PREFERRED EMBODIMENT

Figure 1:
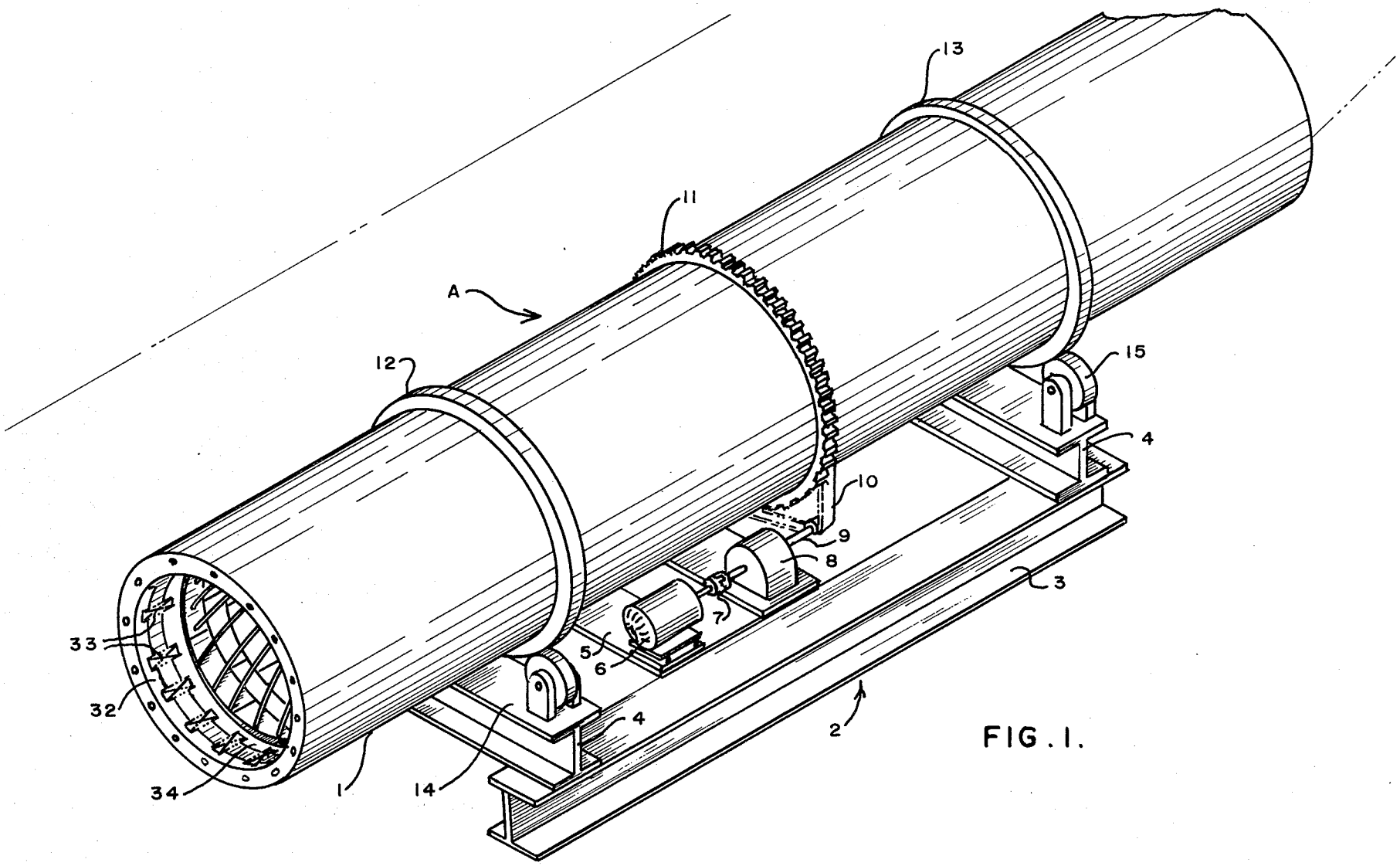
FIG. 1 provides an isometric view of the casting shake-out unit of this invention.

In FIGS. 1 through 4 of the drawings, there is generally disclosed the casting shake-out unit A of this invention, comprising a cylindrical member, or outer cylinder 1, being supported in a generally horizontal direction, or perhaps slightly augulated longitudinally, upon its base 2.

This base may be formed from a variety of structural members, such as the longitudinal I-beams 3 and the transversely arranged I-beams 4 as shown. In addition, a plate or plates 5 may extend the spacing between the beams 3 and provide the support upon which a motor means, such as 5 horsepower alternating current motor shown at 6, which in turn is coupled by means of mechanical coupling means 7 to a speed reducer 8, which provides for the speed of revolving of the cylindrical member 1 somewhere in the vicinity of six, more or less, revolutions per minute. The shaft 9 extending from the reducer is designed for meshing with the belt means 10, which may comprise a form of sprocket drive type of link belt, which is disposed for intergearing with the teeth of the sprocket 11 rigidly afixed around the outer circumference of the cylinder 1, as shown.

Figure 3:
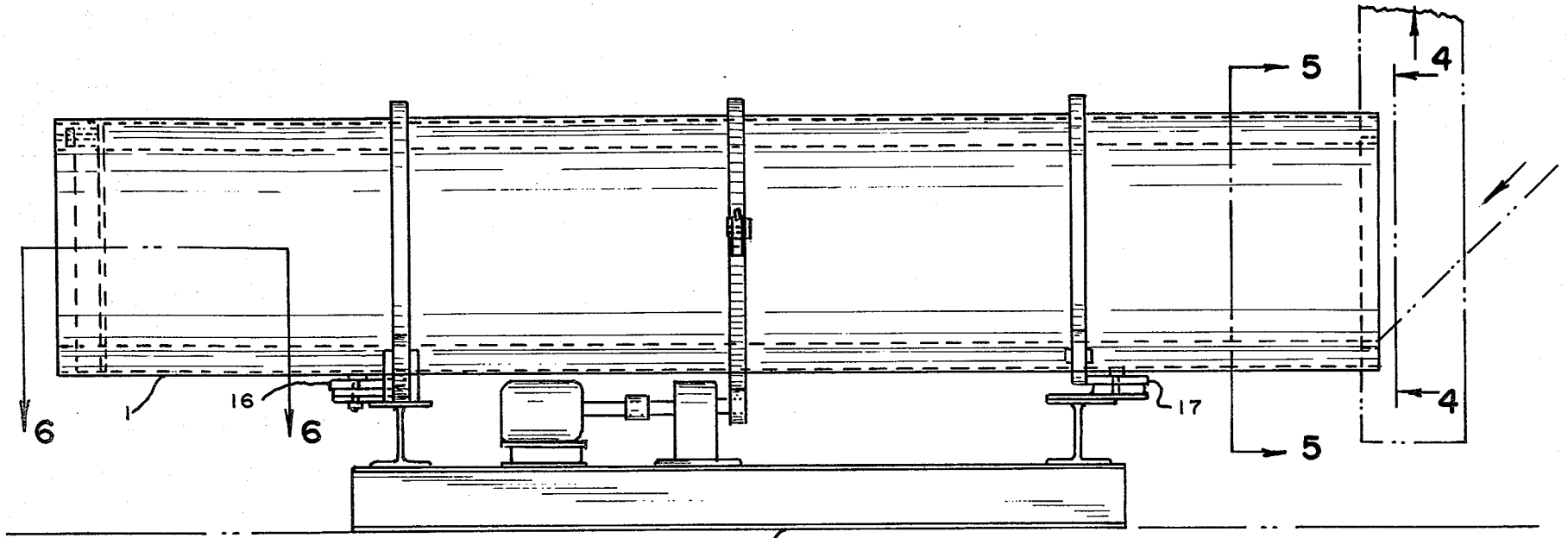
FIG. 3 provides a side view of the casting shake-out unit.

To further provide stability to the support of the cylinder portion 1 of the shake-out unit upon its base, a pair of spaced apart guide, tracks, or races, 12 and 13, are also mounted peripherally around the outer cylinder 1 and aligned for resting, respectively, upon the sets of roller bearings 14 and 15. Any form of curved mating, or tongue and groove type of mating, between the roller bearing and their respective races may be provided for the purpose of fixing the cylinder 1 longitudinally with respect to its seating upon said sets of roller bearings and the base 2, so as to prevent the dislodgment of the same. Obviously, other forms of structure may be utilized for fixing the longitudinally disposed cylinder with respect to its base so as to insure its mating relationship upon the sets of bearings 14 and 15. For example, as shown in FIG. 3, positioning bearings 16 and 17 may engage with the sides of tracks 12 and 13 so as to fix the longitudinal location of the cylinder upon its base as shown.

Figure 2:
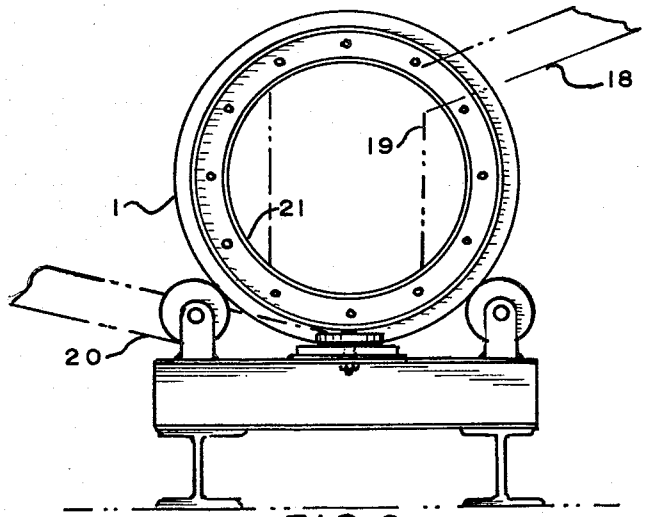
FIG. 2 provides a front end view of the shake-out unit, in addition to disclosing conveyor means at its back end that both conveys the fresh castings to the unit, while a lower conveyor is provided for gathering and transferring any loosened mold sand.

The means for conveying the sand encrusted castings to the cylinder of this shake-out unit is shown in FIG. 2, and may comprise a belt conveyor, or vibrating conveyor, 18, which cooperates with a chute, as at 19, for delivering and depositing castings into the interior of the unit. In addition, and where the loosened sand may be transferred to the back end of the unit during operation of the same, a second conveyor means as at 20 may be positioned slightly under the said back end of the unit for transferring the collected sand to a remote location either for storage or reuse.

Figure 4:
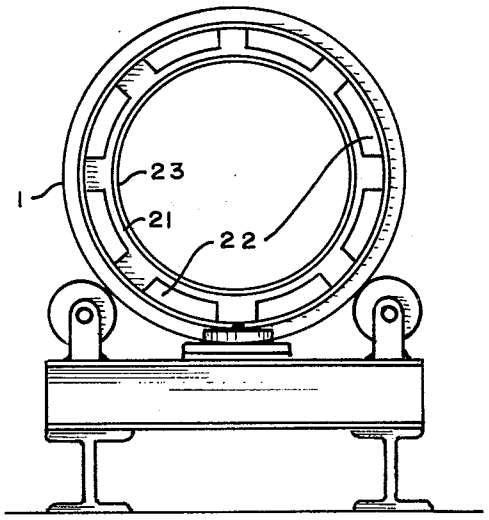
FIG. 4 discloses a back end view of the casting shake-out unit.
Figure 5:
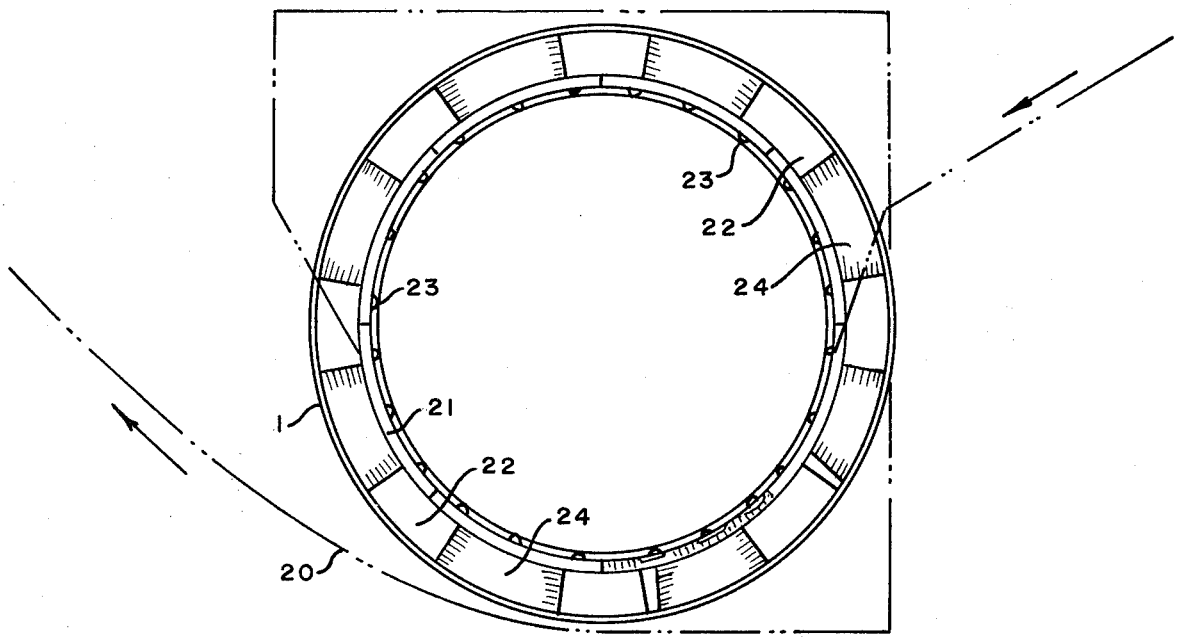
FIG. 5 provides a sectional view of the shake-out unit taken along the line 5—5 of FIG. 3, in addition to showing the delivery and removing conveyances associated with the back end of said unit.
Figure 6:
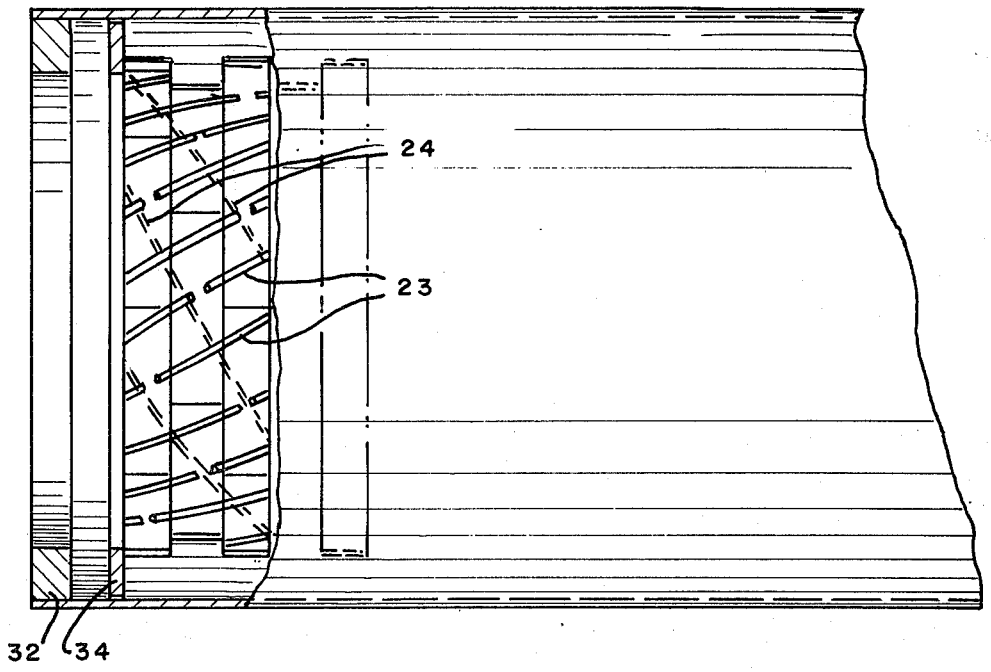
FIG. 6 provides a partial longitudinal sectional view taken along the line 6—6 of FIG. 3.

As can further be seen in FIGS. 4 and 5, the cylindrical member 1 of the shake-out unit is actually formed of two concentrically arranged cylindrical members, such as the outer cylindrical member 1, as previously defined, and as inner cylindrical like surface 21. This inner cylinder 21 is generally formed having spaced apertures, as will be later shown and described, so that the encrusted sand adhering to the new castings when it is tumbled loose will fall through the cylinder apertures and become located in the spacing intermediate the said inner cylinder 21, and the outer cylinder 1, as generally depicted at 22. As also shown in FIG. 6, the inner cylinder 21 is provided with a series of helically arranged spaced ribs 23 which function in the nature of rifling to provide a means for urging the castings along the longitudinal dimension of the inner cylinder as the shake-out unit is rotated upon its base. As can be seen in this FIG. 6, as the combined cylindrical members are rotated, as in a clockwise direction, the rifling will have a tendency to urge the castings forwardly of the units, simultaneously as they are tumbling within the cylinder, and gradually achieve a deliverance of the said castings to the front end of the unit. In addition, in the spacing 22 provided intermediate the inner cylinder 21 and the outer cylinder 1 there are located a series of vane like members 24, which in this particular embodiment, are shown to be helically angulated just the opposite from the positioning of the ribs 23, and therefore, as the shake-out unit is operated, provides for a gradual urging and shifting of the sand falling within the spacings 22 to be moved rearwardly of the unit as it turns clockwise upon its base. Hence, in this particular embodiment, while the castings are gradually moved forwardly within the unit, the loosened sand will simultaneously be forced rearwardly by operation of the vanes 24 for its gradual fall from the back end of the unit into any form of hopper for removal by the conveyor 20.

It can also be seen, and as previously analyzed, that should the vanes 24 have the same angular and helical disposition as the ribs or rifling 23, then the sand falling into the spacings 22 will also be urged forwardly of the shake-out unit during its operation. In that particular instance, it might be desirable to slightly modify the frontal structure of the unit so that either the inner cylinder 21 may extend slightly beyond the front of the outer cylinder 1, so that as the sand falls out of the outer cylinder, the castings will yet be conveyed an additional short distance before they likewise drop from the unit for collection and perhaps conveyance. Obviously, it would not be desirable to have the sand and castings fall into the some collecting bin since this would once again have a tendency to cause intermixture of these two members, and minimize the benefits of this invention. Additionally, and where the inner and outer cylinders are constructed to the same length, it might be desirable to provide a short distance of aperturing proximate the forwardmost end of the outer cylinder 1, so that the sand may fall therethrough before reaching the end of the unit, while the castings are yet conveyed to the end of the same. This would also provide a separate spaced collection of the castings and its loosened mold sand.

In those particular instances where the shake-out unit may be mounted upon a slight incline, and hence both the castings and sand will gradually longitudinally shift due to gravity attracting, it is possible that the vanes 24 may be replaced with any form of structure means to provide the spaced disposition of the inner cylinder concentrically within the outer cylinder. In such instance the ribs 23 may also not be required due to the natural shift of the castings upon the inner surface of the cylinder 21.

Figure 7:
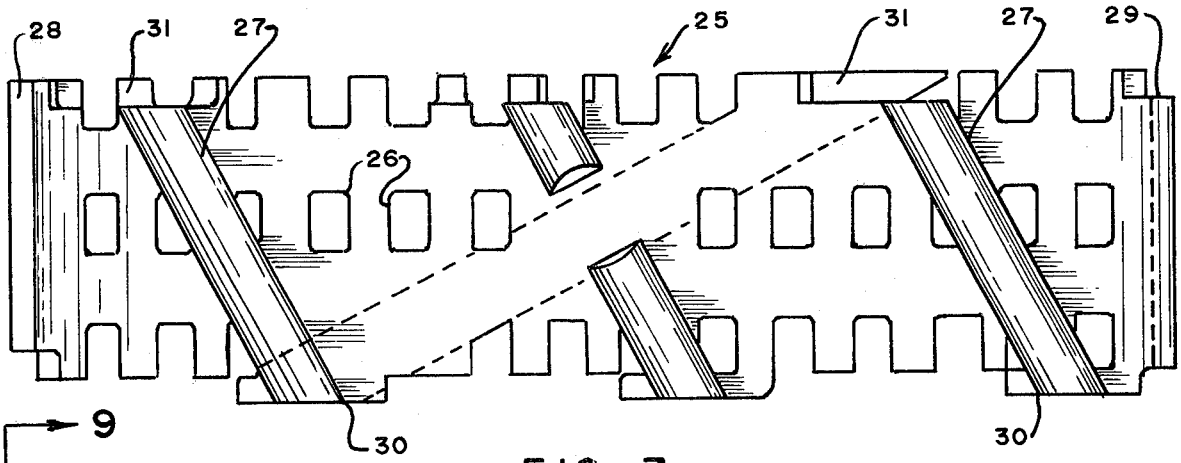
FIG. 7 discloses a top view of one modular segment of the perforated inner concentric cylinder of the shake-out unit.
Figure 8:
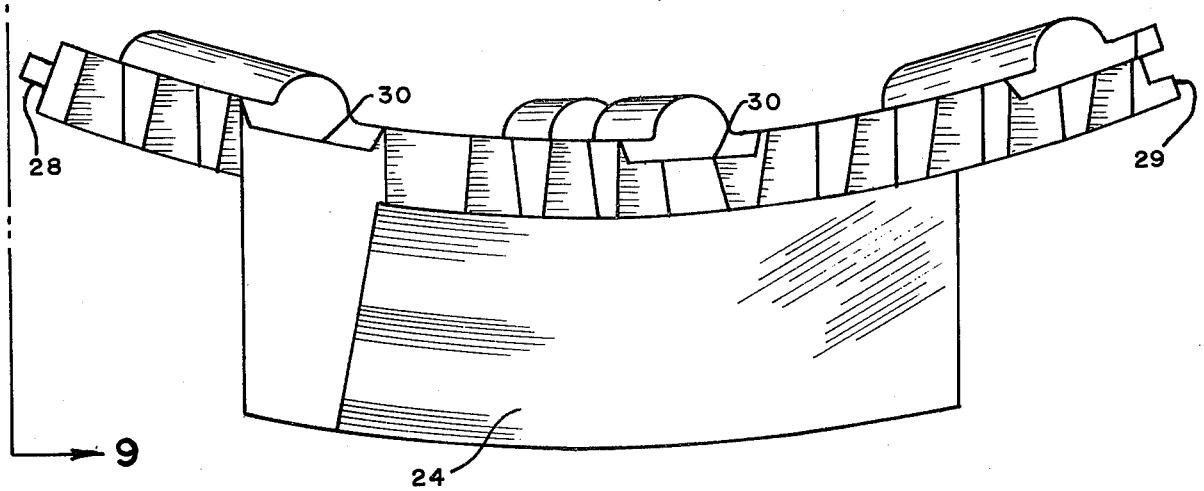
FIG. 8 provides an end view of one modular segment of the inner cylinder shown in FIG. 7.
Figure 9:
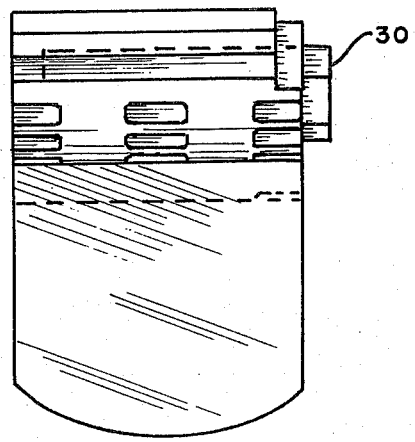
FIG. 9 provides a side view of the inner cylinder modular segment shown along the line 9—9 of FIG. 8.

A further benefit of this invention is also dislcosed in FIGS. 7 through 9, wherein there is shown how the inner cylinder 21 may be formed of modules or sections of partial cylindrical grates that may be joined together to form a complete inner cylinder. As shown, and as also can be seen from FIG. 6, these individual modules each comprise a partial segment 25 of the circumference of the designed inner cylinder, with each segment being repeatedly apertured, as at 26, so as to provide the performations through which the loosened sand may fall, as previously described, with short lengths of the helical ribs 27 being provided thereon to function as the rifling or ribs furnishing the means for gradual conveyance of the castings within the inner cylinder. It can be seen that these ribs 27 may be integrally molded or rigidly welded, or otherwise secured, to each cylinder segment, upon its inner surface. Integrally formed upon the outer surface of each segment 25 is a section of a vane 24, as previously analyzed, which is designed to extend the distance intermediate the inner cylinder 21 and the outer cylinder 1. Each cylinder segment 25 is provided with means for interlocking with the next adjacent segment, such as formed by the tongue and groove arrangements 28 and 29, as shown. As an alternative or supplemental means for interlocking the segments together, lengthwise, mating parts 30 may be provided extending a short distance proximate the rib end 27, and interfit within the corresponding grooved segments 31 provided upon the opposite edge of each segment. Hence, it can be easily seen that as the inner cylindrical surface 21 may become worn due to prolonged exposure to the tumbling castings, and as their rifling or ribs 27 may be worked to the extent that they present insufficient height to achieve the longitudinal movement of the said castings, then the various grate sections that form this inner cylinder may be readily removed and replaced with new segments.

Where the inner cylinder 21 is formed sectionalized, as shown and described in FIGS. 6 through 9, it is generally desirable to provide some means for retaining the longitudinally disposed ends of these cylinder segments fixed in place. As shown in FIG. 1, each end of the outer cylinder 1 may be provided with an integral or fixed ring 32, which ring at one end, such as perhaps at the back end of the unit, may have the inner cylinder sections interlocking therewith, while at the forward end a series of circumferencially disposed tightening bolts or springs, as at 33, may urge a positioning ring 34 tightly against the adjacent edge of the inner cylinder sections so as to tightly bind them and interlock them together within the unit. This securement remains rigidly fixed until the members 33 are once again loosened and removed so that the ring 34 may be slid forwardly to provide the individual removal of the cylinder sections 25 for replacement as previously explained.

Numerous variations in the construction of the shake-out unit of this invention, all within the scope of the appended claims, will occur to those skilled in the art in light of the foregoing disclosure. The described embodiment in merely illustrative of the principle of operation and the results to be obtained from such a structure and is intended principally for illustrative purposes. Any modified structure encompassed within the scope of the following claims are intended to be protected by any patent issuing thereon.

Having thus described the invention what is claimed and desired to be secured by Letters Patent is:

1. A casting shake-out unit of the type useful for facilitating the separation of a new casting from its mold sand or the like comprising a cylinder longitudinally disposed generally in an approximate horizontal position and arranged for slowly rotating around its longitudinal axis, bearing means povided for supporting said cylinder during its rotation, means cooperating with the cylinder for furnishing its slow speed of rotation, an apertured surface provided concentrically inwardly from the inner surface of said cylinder and designed for simultaneously rotating therewith, a series of helically arranged ribs formed upon the inner surface of said apertured surface and being arranged for urging the castings deposited thereon to move longitudinally of the rotating cylinder, a series of helically arranged vanes provided intermediate the apertured surface and the cylinder for inducing the movement of the sand passing through the apertured surface to also be moved longitudinally of the cylinder, said helical ribs being integral with the inner surface of the apertured surface, the helical vanes being integral with the outer surface of said apertured surface, and said apertured surface and its integral ribs and vanes being sectionalized and comprising a series of modular components which during assembly are capable of fitting together to form a complete apertured surface inwardly of the inner surface of the longitudinal cylinder.

2. The invention of claim 1 wherein the arrangement of the rib means upon the apertured surface and the arrangement of the vane means intermediate the apertured surface and the inner surface of the cylinder induces the castings and loosened mold sand to move towards opposite ends of the longitudinal cylinder during operation of the shake-out unit.

3. The invention of claim 1 wherein the arrangement of the rib means upon the apertured surface and the arrangement of the vane means intermediate the apertured surface and the inner surface of the cylinder induces the castings and the loosened mold sand to move towards the same end of the longitudinal cylinder during operation of the shake-out unit.

4. The invention of claim 1 wherein the longitudinal cylinder is arranged horizontally.

5. The invention of claim 1 wherein the cylinder is arranged along its longitudinal axis on a slant with respect to the horizontal.

6. The invention of claim 1 wherein the longitudinal cylinder and its concentric apertured surface are of the same length.

7. The invention of claim 1 wherein the length of the apertured surface is longer than the length of the longitudinal cylinder so that the former extends out of at least one end of the latter cylinder.

8. The invention of claim 1 wherein the means for rotating said cylinder comprises a motor.

9. The invention of claim 8 wherein a belt means cooperates between the motor and the outer surface of the longitudinal cylinder for effecting the slow speed of rotation of the cylinder during operation of the shake-out unit.

10. The invention of claim 8 and including a base member provided for holding the motor means, bearing means, and longitudinal cylinder and furnishing stability during operation of the shake-out unit.

11. The invention of claim 9 wherein said belt means comprises a sprocket chain, a sprocketed annulus connecting to and surrounding the outer circumference of the cylinder, said chain intermeshing with said annulus to achieve the said slow speed of rotation of the shake-out unit during its operation.

12. The invention of claim 8 and including a speed reducer coupled between the motor and said cylinder to achieve the slow speed of revolution of the shake-out unit during its operation.

13. The invention of claim 1 wherein the bearing means comprises at least a pair of bearing sets, each set being spaced apart and cooperating with the proximate under surfaces of the cylinder to provide its support during functioning of the shake-out unit.

14. The invention of claim 13 wherein each bearing set included a pair of roller bearings, one of each roller bearings being arranged to either underside of the cylinder to provide stable support for the shake-out unit during its operation.

15. The invention of claim 14 and including an annular track formed circumferentially surrounding the outer surface of the longitudinal cylinder and providing a surface for contact by the roller bearings, therebeing a track provided upon the cylinder surface for cooperating with each roller bearing set.

16. The invention of claim 1 and including a conveyor means arranged proximate one end of the shake-out unit and disposed for delivering the sand encrusted castings to its cylinder during its operation.

17. The invention of claim 1 wherein the helical ribs comprise rifling formed upon the inner surface of the apertured surface.

18. The invention of claim 1 wherein the helical vanes are arranged coextensively with the said helical ribs.

19. The invention of claim 1 wherein the helical vanes are arranged in an opposite direction with respect to the arrangement of said helical ribs.

20. The invention of claim 1 wherein the helical ribs are integral with the inner surface of the apertured surface, and the helical vanes are integral with the outer surface of the said apertured surface.

21. The invention of claim 1 wherein the side of each modular component of the apertured surface is provided with a shoulder like formation for mating and locking with the adjacent components during assembly of the complete apertured surface within the longitudinal cylinder.

22. The invention of claim 21 and including a removable retainer ring provided approximate at least one end of the cylinder and disposed for securing the modular components of a completed apertured surface in place during functioning of the shake-out unit.

23. The invention of claim 22 wherein said retainer ring cooperates with bolts for securing the complete modular apertured surface securely in place during operation of the shake-out unit.

24. The invention of claim 22 and including spring means arranged intermediate an approximate end of the cylinder and the retainer ring for urging it against the proximate edge of the modular apertured surface for securing the said surface in place during functioning of the shake-out unit.

25. The invention of claim 1 wherein the cylinder is also apertured.

26. A casting shake-out unit of the type useful for facilitating the separation of a new casting from its mold sand, and including a longitudinally disposed cylinder having an inner apertured surface concentrically arranged therein, the improvement which comprises said apertured surface being sectionalized, and comprising a series of modular components which during assembly are capable of being fitted together to form a complete apertured surface inwardly from the inner surface of the longitudinal cylinder, each modular component of the apertured surface including a segment of an integral rib formed upon its inner surface, and a segment of an integral vane formed upon its outer surface.

27. The invention of claim 26 wherein the side of each modular component of the apertured surface is provided within a shoulder like formation for mating and locking with the adjacent components during assembly of the complete apertured surface within the longitudinal cylinder.

* * * * *

UNITED STATES PATENT OFFICE
CERTIFICATE OF CORRECTION

Patent No. 3,998,262 Dated December 21, 1976

Inventor(s) Charles J. Didion

It is certified that error appears in the above-identified patent and that said Letters Patent are hereby corrected as shown below:

Claim 1, line 18, change "povided" to --- provided ---.

Claim 14, line 26, change "included" to --- includes ---.

Claim 27, line 11, change "within" to --- with ---.

Signed and Sealed this

First Day of March 1977

[SEAL]

*Attest:*

RUTH C. MASON
*Attesting Officer*

C. MARSHALL DANN
*Commissioner of Patents and Trademarks*